US006183230B1

(12) United States Patent
Beardmore et al.

(10) Patent No.: US 6,183,230 B1
(45) Date of Patent: Feb. 6, 2001

(54) ISOLATED ENGINE OIL PUMP DRIVE

(75) Inventors: John Meade Beardmore, Howell; Bruce Alan Tucker, Brighton, both of MI (US)

(73) Assignee: General Motors Corporation, Detroit, MI (US)

( * ) Notice: Under 35 U.S.C. 154(b), the term of this patent shall be extended for 0 days.

(21) Appl. No.: 09/272,853

(22) Filed: Mar. 19, 1999

(51) Int. Cl.[7] ..... F04C 2/10
(52) U.S. Cl. ..... 418/171; 403/359.6; 464/89
(58) Field of Search ..... 418/166, 170, 418/171; 464/87, 89, 92; 403/359.1, 359.5, 359.6

(56) References Cited

U.S. PATENT DOCUMENTS

| | | | | |
|---|---|---|---|---|
| 2,443,688 | * | 6/1948 | McFarland | 403/359.1 |
| 2,872,872 | * | 2/1959 | Quintilian | 418/171 |
| 2,887,063 | * | 5/1959 | Aspelin | 418/171 |
| 2,956,187 | * | 10/1960 | Wood | 464/89 |
| 3,650,361 | | 3/1972 | Fossum | 192/30 |
| 4,098,096 | * | 7/1978 | Chard et al. | 464/89 |
| 5,314,319 | * | 5/1994 | Nilsson et al. | 418/171 |
| 5,927,149 | * | 7/1999 | Moody | 464/89 |

* cited by examiner

*Primary Examiner*—John J. Vrablik
(74) *Attorney, Agent, or Firm*—Laura C. Hargitt

(57) ABSTRACT

An oil pump drive assembly for an internal combustion engine includes a source of rotational input such as a crankshaft and a splined hub mounted to the crankshaft for rotation therewith. The splined hub has male splines extending about the outer perimeter to transfer rotational load to drive an oil pump. The oil pump includes a pump body housing a gerotor pump set, which includes an internally lobed pumping annulus and a pump rotor. The pump rotor has lobes along the outer surface to engage the internally lobed pumping annulus and female splines along the inner surface which compliment and receive the male splines of the splined hub for meshing engagement to operatively connect the crankshaft and the gerotor pump set. The oil pump further includes a splined isolator ring disposed between the pump rotor and the splined hub wherein the inner periphery of the isolator ring is configured for meshing engagement with the male splines of the splined hub and the outer periphery of the isolator ring is configured for meshing engagement with the female splines of the pump rotor. The splined isolator ring operates to minimize noise generation upon impacts between the splined hub of the crankshaft and the pump rotor.

5 Claims, 4 Drawing Sheets

ISOLATED ENGINE OIL PUMP DRIVE

TECHNICAL FIELD

The invention is directed to an engine oil pump and drive assembly.

BACKGROUND OF THE INVENTION

The gerotor pump has emerged as a preferred means of providing lubrication for internal combustion engines attributable to its efficiency and packaging benefits. The pump is placed on center with the crankshaft axis and is generally driven by a coarse splined hub mounted on the crankshaft. The crankshaft's coarse splined hub extends through a central opening in the pump's rotor to engage female splines of the pump rotor, transferring rotational energy therebetween. Adequate clearance within the spline drive is required because tight tolerances impede assembly.

As the gerotor oil pump has become more common place in the field, unsatisfactory noise levels have been observed. Root causing the source unveiled noise introduced as a result of longitudinal crankshaft flexure during high engine loading. This longitudinal bending imparts a radial impact between the top flat of the male spline and the receiving female spline surface. Torsional shaft deflections also occur, causing tangential impacts between the radial faces of mating male and female splines. In addition, large tolerances between the mating splines generate a rattling noise from torsional spline-to-spline impacts at lower engine speeds due to pump pressure pulsations and instantaneous engine speed fluctuations. Simply increasing the clearance between the splines eliminates crankshaft motion-induced noise but aggravates drive "rattle". Resolving noise concerns will increase customer satisfaction with the engine package.

SUMMARY OF THE INVENTION

To resolve the discovered noise source concern, the present invention provides a pump drive system which can accommodate motion of the crankshaft, relative to the pump, without generating gear impact noise. An isolator is interposed between the pump rotor and the driving splined hub to minimize noise generation upon impact of the male splines with the female splines. All faces, arc and radial, of the splines are isolated to absorb radial impacts as well as tangential impacts. This isolator provides a forgiving system which accommodates crankshaft flexure and torsion without resulting noise. In addition, the system maintains the fail-safe feature inherent in a spline drive system because if the isolator should deteriorate, the splines will still engage to drive the pump.

DESCRIPTION OF THE PREFERRED EMBODIMENT

Figure 1:
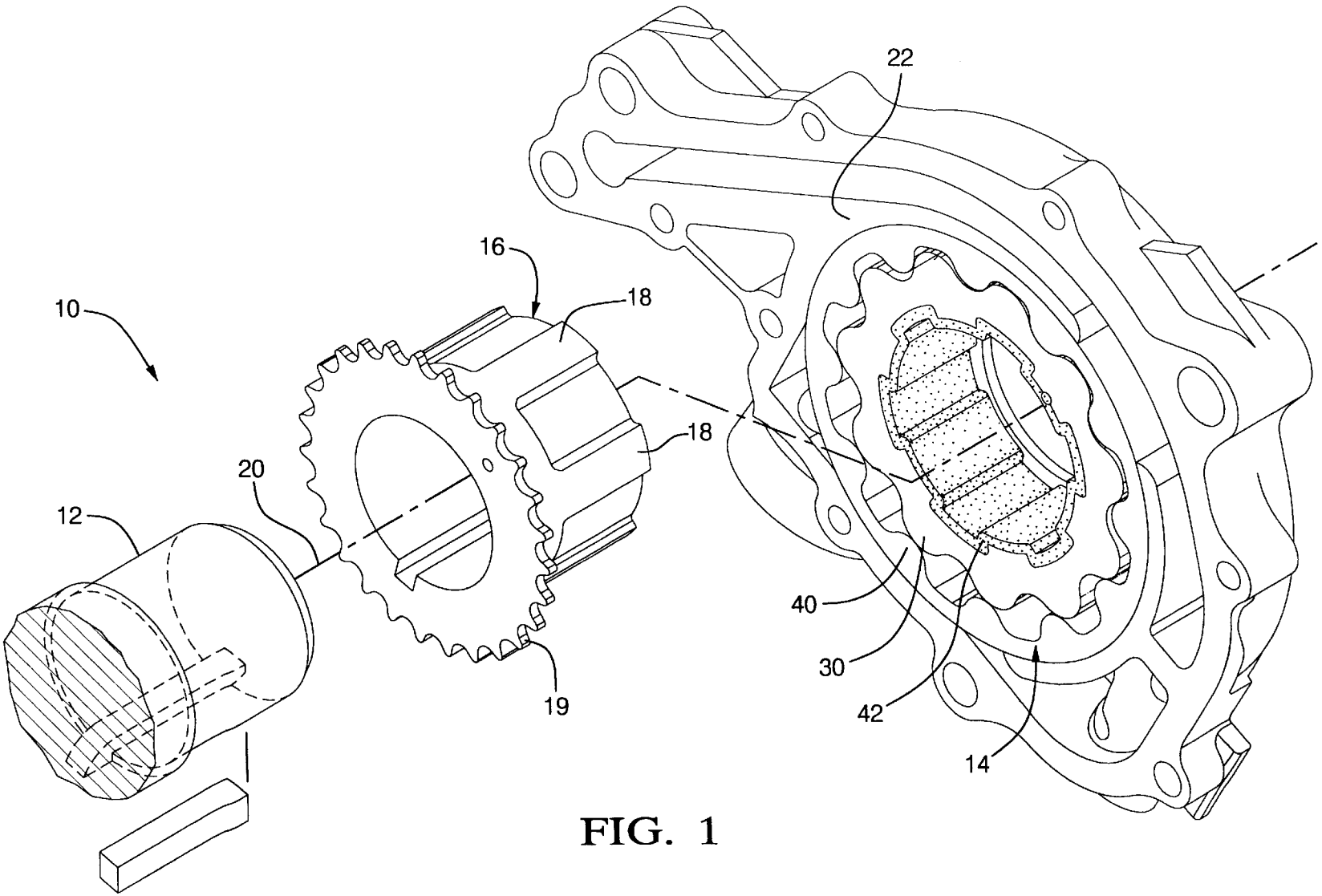
FIG. 1 is an expanded isometric view of a portion of an engine oil pump drive assembly and engine oil pump embodying the present invention.

In FIG. 1 an engine oil pump drive assembly 10, provides the driving force for an engine oil pump 14, such as a gerotor oil pump for an internal combustion engine. The pump drive assembly 10 includes a coarse splined hub 16 mounted to a source of rotational input, such as an engine crankshaft 12, for direct rotation therewith. The splined hub 16 has male splines 18 extending about the outer perimeter thereof and the hub may be incorporated with a timing chain sprocket 19.

Figure 2:
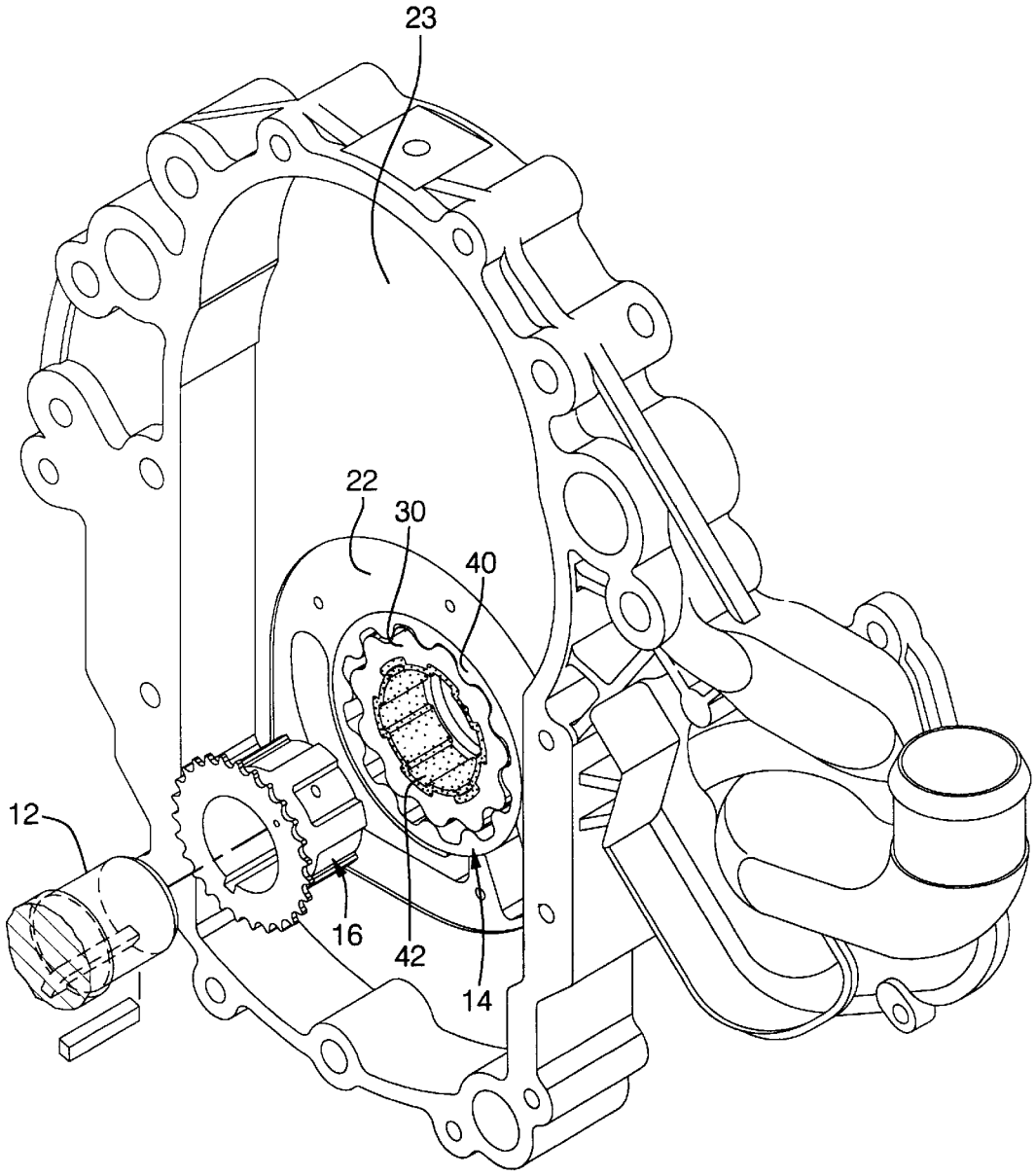
FIG. 2 is an expanded isometric view of a portion of an engine oil pump drive assembly and engine oil pump embodying the present invention integrated in an internal combustion engine.
Figure 3:
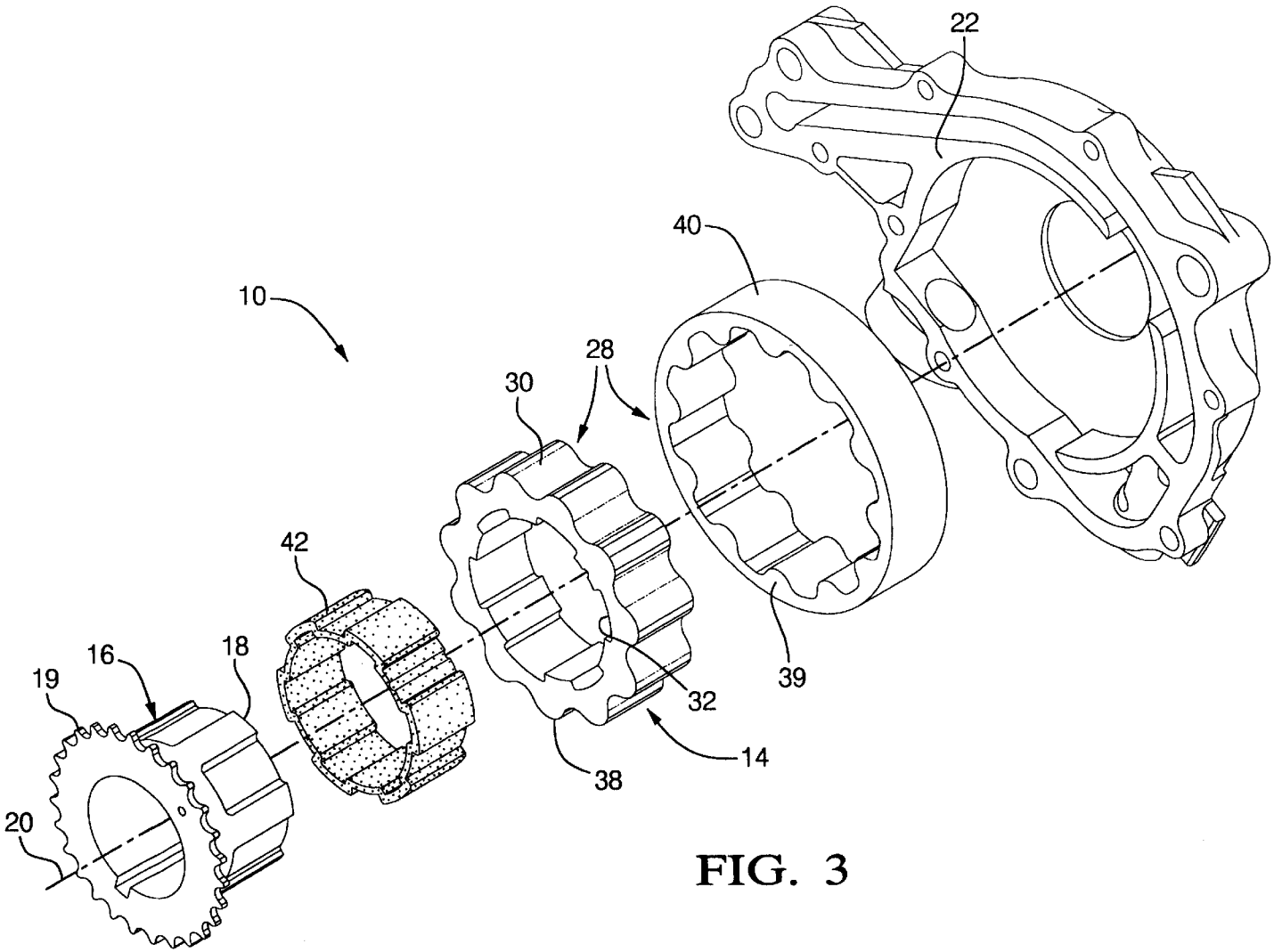
FIG. 3 is a further expanded isometric view of FIG. 1.

The oil pump 14 comprises a pump body 22 that is mounted to the engine, in particular to the front face of the cylinder case, not shown, or is integrated within the front cover assembly 23, as shown in FIG. 2. The pump body 22 is provided with appropriate inlet and outlet ports for oil to be circulated by the pump 14. Referring to FIG. 3, the pump body houses a gerotor pump set 28 which includes a pump rotor 30 and a pumping annulus 40.

Figure 5:
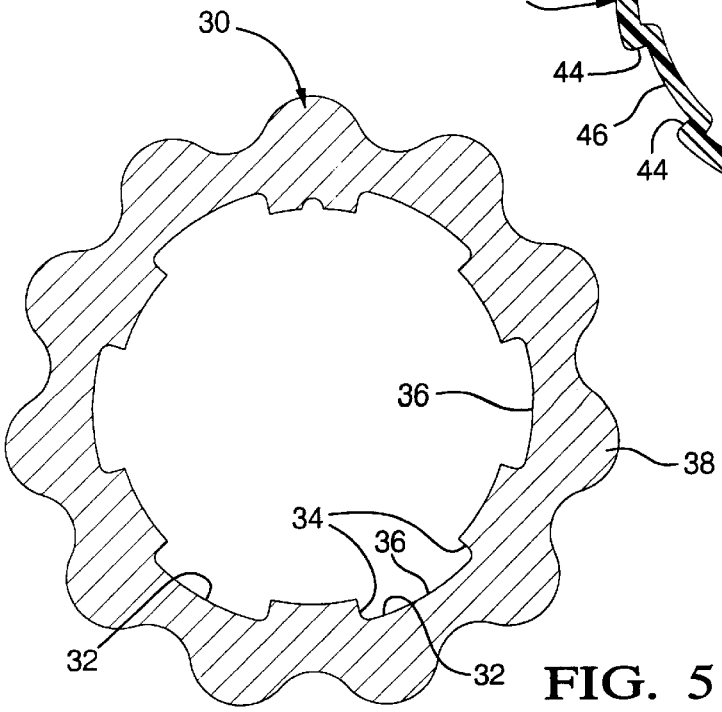
FIG. 5 is a sectional front view of a pump rotor.

The pump rotor 30 is placed on center with the longitudinal crankshaft axis 20 and receives the splined hub 16 of the crankshaft 12. The pump rotor 30 has female splines 32 along the inner surface which compliment the male splines 18 of the splined hub 16 for meshing engagement. As shown in FIG. 5, each of the female splines 32 of the pump rotor 30 is defined by two radially extending faces 34 with an arc face 36 extending therebetween.

Figure 4:
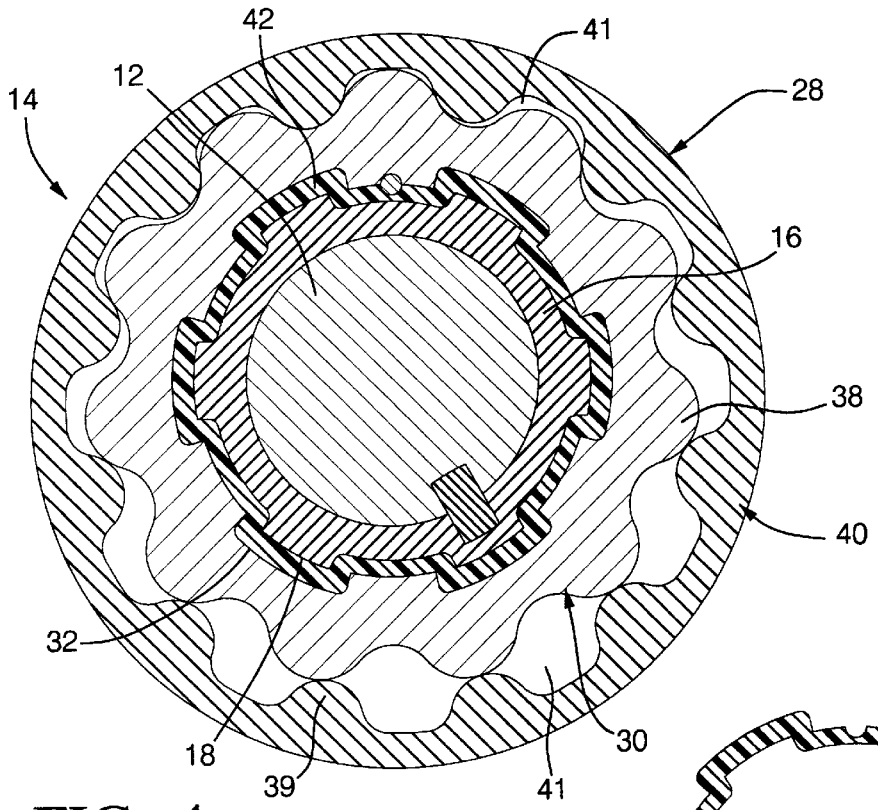
FIG. 4 is a sectional front view of a portion of the engine oil pump and drive assembly of FIG. 1.

Along the outer surface of the pump rotor 30, there are lobes 38 to engage the annulus lobes 39 of the internally lobed pumping annulus 40 as illustrated in FIG. 4. The non-meshing lobes 38,39 define chambers 41 therebetween. As the rotor 30 and pumping annulus 40 turn relative to each other, oil is drawn into the chambers 41 as the chamber size increases and is expelled through the outlet port as the chamber size diminishes.

Figure 6:
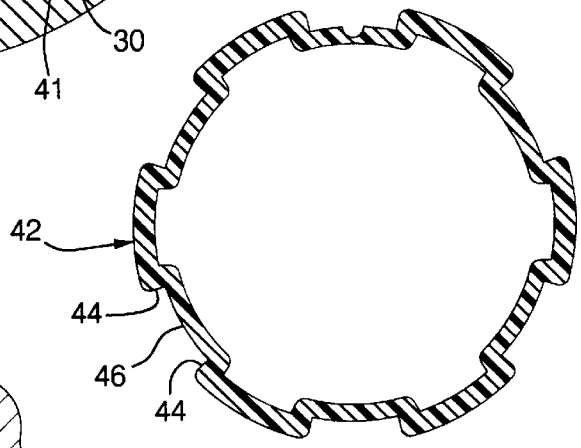
FIG. 6 is a sectional front view of an isolator ring.

FIG. 4 illustrates a splined isolator ring 42 disposed between the pump rotor 30 and the splined hub 16 of the crankshaft 12. The inner periphery of the isolator ring 42 is configured for meshing engagement with the male splines 18 of the splined hub 16. As shown in FIG. 6, the outer periphery of the isolator ring 42 is defined by radial walls 44 and arc walls 46 extending between the radial walls which compliment the radially extending faces 34 and arc faces 36 respectively of pump rotor 30, for slip fit meshing engagement therewith.

Alternatively, the splined isolator ring 42 may be integrally fixed such as by overmolding on to either the pump rotor 30 or the splined hub 16. Where the splined isolator ring 42 is overmolded as an integral part of the pump rotor 30, the female splines 32 would be considered isolated, i.e. isolatable female splines. An integrally supplied isolator provides ease of assembly.

The material selected for the splined isolator ring may be a compliant material such as a nitrile rubber or a less compliant material such as Nylon, Teflon, or a phenolic. It is preferred that the material selected have oil resistance properties.

To activate the pump 14, the source of rotational input such as the crankshaft 12 rotates the splined hub 16, which in turn rotates the pump rotor 30 by meshing engagement of the mating male and female splines 18,32. This configuration operatively connects the rotational input and the gerotor pump. The splined isolator ring 42 operates to "cushion" bending-induced impacts of the male splines against the arc faces 36 and twisting-induced impacts of the male splines 18 against the radially extending faces 34 of the pump rotor female splines 32. In this manner, the splined isolator ring 42 minimizes noise generation that may be generated from metal to metal impacts of the splines 18,32.

The splined isolator ring may also be used with other style oil pumps driven by the crankshaft such as a crescent gear pump. However it is the extremely close internal tolerances of the gerotor pump and its geometric relationship to the crankshaft centerline that creates the likelihood of drive spline impacts.

It is anticipated that the isolator ring would not reduce the failsafe feature inherent in a spline drive system. If the isolator material degraded, the male and female splines would still engage to operate the engine oil pump without the risk of engine inoperation.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. An oil pump for an internal combustion engine comprising a splined hub directly rotatable by a source of rotational input and having male splines extending about the outer perimeter of said splined hub, a pump body housing a gerotor pump set, said gerotor pump set including an internally lobed pumping annulus and a pump rotor having lobes along the outer surface of said pump rotor, to engage said internally lobed pumping annulus, and female splines along the inner surface of said pump rotor which compliment and receive said male splines of said splined hub for meshing engagement to operatively connect said splined hub and said gerotor pump set, and a splined isolator ring disposed between said pump rotor and said splined hub wherein the inner periphery of said isolator ring is configured for meshing engagement with said male splines of said splined hub and the outer periphery of said isolator ring is configured for meshing engagement with said female splines of said pump rotor and wherein said isolator ring is formed of a compliant material to minimize noise generation upon impacts between said splined hub and said pump rotor.

2. An oil pump comprising a pump body housing a gerotor pump set, said gerotor pump set including an internally lobed pumping annulus and a pump rotor having lobes along the outer surface of said pump rotor to engage said internally lobed pumping annulus and having female splines, along the inner surface of said pump rotor, having an integral isolator fixed to said female splines and configured for meshing engagement with male splines transferring rotational drive load and wherein said integral isolator is formed of a compliant material to cushion the transferred rotational drive load.

3. A gerotor oil pump and oil pump drive assembly for an internal combustion engine comprising a crankshaft, a splined hub mounted to said crankshaft for rotation therewith and having male splines extending about the outer perimeter of said splined hub, a pump body housing a gerotor pump set, said gerotor pump set including an internally lobed pumping annulus and a pump rotor having lobes along the outer surface of said pump rotor, to engage said internally lobed pumping annulus, and female splines along the inner surface of said pump rotor which compliment and receive said male splines of said splined hub for meshing engagement to operatively connect said crankshaft and said gerotor pump set, and a splined isolator ring disposed between said pump rotor and said splined hub wherein the inner periphery of said isolator ring is configured for meshing engagement with said male splines of said splined hub and the outer periphery of said isolator ring is configured for meshing engagement with said female splines of said pump rotor and wherein said isolator ring is formed of a compliant material to minimize noise generation upon impacts between said splined hub of said crankshaft and said pump rotor.

4. An oil pump and oil pump drive assembly, as defined in claim 3, wherein each of said female splines of said pump rotor is defined by two radially extending faces and an arc face extending therebetween, and wherein the outer periphery of said isolator ring is comprised of radial walls and arc walls extending between said radial walls for meshing engagement with said radially extending faces and said arc faces respectively of said pump rotor, said radial walls and said arc walls of said splined isolator ring operable to cushion impacts of both said male spline against said radially extending faces and said male spline against said arc faces of said pump rotor due to crankshaft motion to insure engagement of said male spline with said female spline in case of degradation of said splined isolator ring.

5. An oil pump and oil pump drive assembly, as defined in claim 3, wherein said splined isolator ring is a complimentarily splined ring configured for slip fit meshing engagement between said female splines of said pump rotor and said male splines of said splined hub.

* * * * *